United States Patent [19]

Held

[11] Patent Number: 4,566,234

[45] Date of Patent: Jan. 28, 1986

[54] WINDOW FRAME WITH LAMINATED SURFACES

[76] Inventor: Kurt Held, Alte Str. 1, D-7218 Trossingen 2, Fed. Rep. of Germany

[21] Appl. No.: 571,448

[22] Filed: Jan. 17, 1984

[30] Foreign Application Priority Data

Jan. 21, 1983 [DE] Fed. Rep. of Germany ..... 3301894

[51] Int. Cl.[4] ..... E06B 3/26

[52] U.S. Cl. ..... 52/209; 52/302; 52/311; 52/475; 52/656; 49/408

[58] Field of Search ..... 52/209, 302, 303, 304, 52/311, 171, 533, 716–718, 474, 475, 656; 49/408; 156/62.2; 285/226

[56] References Cited

U.S. PATENT DOCUMENTS

| | | | |
|---|---|---|---|
| 1,291,511 | 1/1919 | Hester | 52/209 X |
| 1,370,443 | 3/1921 | Hester | 52/209 X |
| 1,533,248 | 9/1925 | Larsen et al. | 52/209 |
| 3,512,320 | 5/1970 | Ferron et al. | 52/311 X |
| 3,834,441 | 9/1974 | Drake | 285/226 |
| 4,201,819 | 5/1980 | Schenz | 156/62.2 |

FOREIGN PATENT DOCUMENTS

| | | | |
|---|---|---|---|
| 701265 | 12/1940 | Fed. Rep. of Germany . | |
| 7137755 | 8/1972 | Fed. Rep. of Germany . | |
| 7624629 | 8/1976 | Fed. Rep. of Germany . | |
| 8024438 | 5/1979 | Fed. Rep. of Germany . | |
| 362968 | 7/1906 | France . | |
| 409950 | 3/1910 | France | 49/408 |
| 799964 | 8/1958 | United Kingdom | 52/209 |

*Primary Examiner*—Donald G. Kelly
*Assistant Examiner*—Richard E. Chilcot, Jr.
*Attorney, Agent, or Firm*—McGeady, Stanger, Goldberg & Kiel Toren

[57] ABSTRACT

A window frame is made up of frame sides connected together at mitered corner joints. The frame sides are formed of a wood or wood material core with a metal foil laminate on the exterior frame surfaces and a decorative laminate on the interior of the frame surfaces. A thin corrugated metal foil is placed over the mitered corner joints and is soldered to the metal foil laminate. Drain bores in the window frame are lined with thin metal pipes. The window frame incorporates the positive properties of wood, plastics and metal without the negative properties.

10 Claims, 2 Drawing Figures

WINDOW FRAME WITH LAMINATED SURFACES

SUMMARY OF THE INVENTION

The present invention is directed to a window frame with a core formed of wood or wood material and with a pressure setting laminate coating. The window frame is made up of frame sides joined together at mitered corner joints with each frame side having an interior surface and an exterior surface. Each frame side has a wood core with a metal foil laminate coated on the exterior surface and with a decorative laminate coated on the interior surface. The outside corners of the frame are covered with a thin metal foil.

In the past buildings have been erected by individual craftsmen, however, in recent years the trend has been to use prefabricated parts not only in the construction of prefabricated houses but also in building conventional houses. The use of prefabricated parts is due mainly to the high cost of manually made parts. Such prefabricated parts can be produced in large quantity lots of at least equal quality with manually made parts and at a much lower cost. This trend includes windows used in high buildings and such use is supported by the DIN 18050 guidelines for window openings.

Window frames employed in house or building construction must meet a variety of requirements. The window frame must be sturdy and torsion-resistant so that its appearance and tightness on the exterior of the building lasts over a long period of years. A determining factor for fulfilling this requirement is the water-and weather-proofness of the frame. At the present day energy prices another important criterion is heat insulation. Still another factor is the soundproof character of the window frames. Finally, the decorative appearance of the window frame must be considered.

While metal, plastics or wood are used in mass-produced window frames they do not meet the above requirements simultaneously in an optimum manner. Metals are good heat conductors and, therefore, additional measures for heat insulation must be provided in metal window frames. Further, metals are a relatively expensive base material. To obtain the necessary stability in plastics window frames, stiffening means must be used which involve costly constructions and materials, such as glass fiber reinforcement. On the other hand, however, metal and plastics window frames are weatherproof and retain their appearance and tightness for years. Wood and wood material while having good torsion stiffness, are poor heat conductors, that is, wooden window frames afford good heat insulation. Moreover, wooden window frames are decorative and considerably enhance the appearance of a house or building. The ability of wood and wood materials to withstand weathering is poor and window frames made from such materials must be given repeated protective treatments over their lifetime. In addition, to maintain the decorative appearance of wooden window frames, high quality clear lumber must be used and results in increasing material costs.

To avoid the use of high quality materials and protective coatings, wooden window frames have been frequently made, because of their desirable properties, by coating inexpensive grades of lumber, which may have knots, material defects and rosin pores, with PVC or acrylate foils. Another advantage of such window frames is that complicated sections, provided with grooves for the sealing of the window frames, can be assembled from single parts in a laminated form, since the applied foil covers the underlying construction. Frames constructed in this manner result in an enormous savings in material and also in the time required for the manufacture of the frames as compared with uncoated window frames provided only with a protective coat of paint which, for visual reasons, must be formed in one piece. In the known coating techniques, foils or covering layers have been utilized which have the same decorative appearance and makeup on both the interior and exterior of the frame, due to their material composition, such frames do not have the vapor proofness and weather resistance of metal. Accordingly, wooden window frames produced in the above manner do not have the required durability.

Therefore, in view of the state of the art, it is the primary object of the present invention to improve the construction of wood or wood material window frames so that they retain the specific advantages of wood and achieve the same weather proofness and durability, without repeated protective treatments, as is possible with metal window frames, and at lower costs. In accordance with the present invention, different covering layers are provided on the exterior surface and the interior surface of a window frame with a wood or wood material core. The exterior surfaces are covered with a metal foil. The joints in the frame are covered with a metal foil so that any movement can be absorbed without exposing the joints. The interior surfaces of the window frame are covered with a decorative laminate.

In accordance with the present invention, window frames can be constructed which combine the positive properties of wood, plastics and metal while avoiding the negative properties of such materials.

For the structural parts of the window frame, a core of wood or wood material is used so that a sturdy and torsion-resistant window frame is obtained. Since wood is a poor heat conductor, the need for additional heat insulation is obviated. Because the visible surfaces of the window frame are covered with pressure setting laminates, the use of lesser grades of wood with imperfections is possible. Another feature of the invention is that by laminating the frame a saving in wood is possible as compared with a wooden frame made in one piece by working or cutting.

The exterior surfaces of the window frame located on the building exterior are covered with a laminate including a metal foil so that the frame is sealed against the penetration of water, and the swelling or shrinking of the wood due to a variable moisture content is kept to a minimum. The metal surface of the exterior laminate may be formed of copper or a special steel so that the exterior frame surface is made gas-tight and vapor-tight at little expense. Further, open joints in the frame, particularly corner joints and drain bores can be coated with a metal foil. A metal foil molding can produce a hermetic seal at the mitered corner joints of the frame. By corrugating such a molding any movement of the wood core due to differences in humidity or temperature can be absorbed without any breaks or leaks developing in the outside coating on the frame. Similarly, by providing circumferential corrugations in thin metal pipes positioned in the drain bores, longitudinal expansion can be absorbed so that such bores are protected in an optimum manner against climatic conditions. Such a window frame with a wood or wood material core has a durability and an ability to withstand weather conditions similar to a metal window frame. If the character of the wood or wood material core requires it, the metal foil and its underlying laminate can be made vapor-permeable by means of micropores to the extent required for the maximum useful lifetime of the wood material.

Since the metal foil is pressure-resistant due to the underlying laminate layer, it can be made very thin so that the metal costs are reduced to a minimum. Further, because of the laminate layer, the thin, inexpensive metal foil is easy to glue and to solder so that the production costs for such window frames are kept low.

Last but not least is the decorative effect obtainable with metal foil laminates in modern architecture. By coating the interior surface of the window frame with a decorative laminate, for example, a wood grain imitation, a desirable interior decorating effect can be achieved. As the laminate is made of a pressure setting plastics material, its surface is extremely resistant to scratching and is particularly chemically stable affording a positive effect on the useful life of the window frame.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
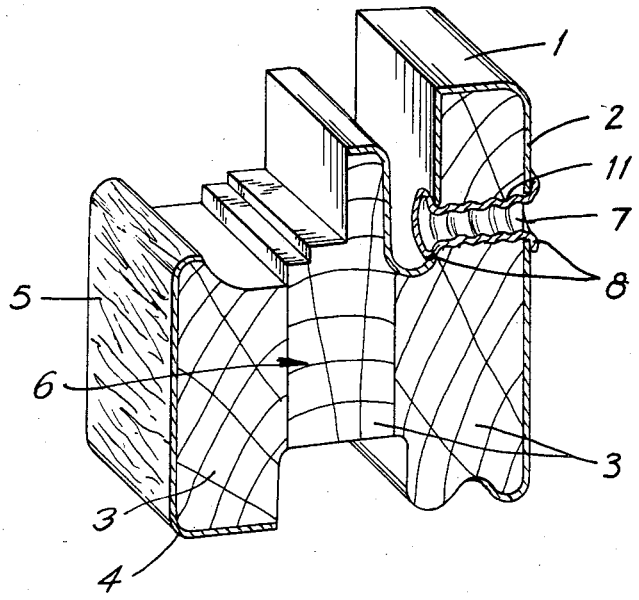
FIG. 1 is a perspective sectional view through a portion of a window frame as viewed from the building interior.

As shown in FIG. 1, a window frame is laminated and fitted together using individual wood strips 3. The strips have been shaped or profiled to afford the required grooves and ribs for the desired appearance of the frame surfaces. The individual strips 3 are glued together into a compact block 6 forming a torsion-stiff, sturdy and heat insulating core for the window frame. The individual strips may be formed of an inexpensive grade of lumber containing knots, rosin pores and other defects, since the visible surface of the frame is covered with laminates 2, 4. If savings in time and material are not to be considered, the window frame core 6 can be produced from a single block or piece of lumber by woodworking techniques. In addition, the window frame core can be formed of a wood material, such as a cemented chipboard or the like. The window frame surface 1 visible on the exterior of a building is coated with a metal foil laminate 2. Such a laminate can be applied in a double band press under the action of heat and pressure. The metal foil laminate 2 consists of a base usually formed of a plurality of layers of phenol or melamine resin-impregnated thick paper. A thinly rolled or electrolytically deposited weatherproof metal foil is adhered to the surface of the base. The metal foil may be formed of copper, aluminum or a special steel foil. The thin, inexpensive metal foil is made pressure-resistant and easy to glue and to solder because of the laminated base and, accordingly, it is easy to work. Due to the pressure setting character of the laminate, a high resistance to water and chemicals is achieved and a great hardness is attained.

Certain woods, for example pine, require, on the side exposed to the outside weather, a vapor-permeable surface protection so that such wood is securely protected against rotting. Therefore, it is within the scope of the present invention to make the metal foil and the laminated base microporous, that is, vapor-permeable to the required degree, or both of the layers making up the exterior surface laminate are semipermeable in the desired direction.

If desired, the exterior surface can be provided with the appearance of knots, flutings, or a fine grain appearance. The metal foil of the metal foil laminate 2 acts as a barrier against vapors and gases and protects the underlying or wood material core against absorption of a wide range of moisture contents and minimizes the swelling or shrinking of the window frame core 6.

Figure 2:
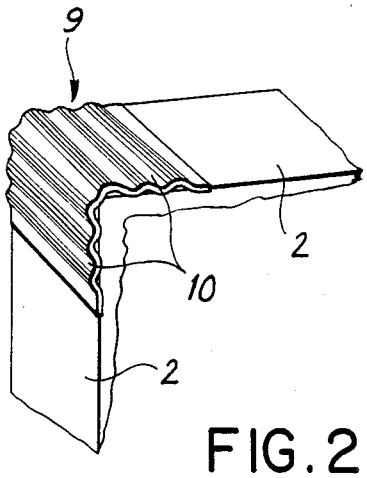
FIG. 2 is a schematic representation of a mitered corner joint formed by two sides of a window frame.

In the remaining open joints in the window frame, such as the corner connections of the frame sides and drain bores 7, vapor proofness is obtained in the following manner. For a vapor proof sealing of mitered corner joints, the joint is covered by a molding 9 formed of a thin metal foil 10, such as illustrated in FIG. 2. The molding is soldered to the exterior surface of the frame and it is corrugated in the region of the joint. The molding 9, however, is not soldered to the underlying metal foil surface in the region of the joint. Any movement of the wood core 6 due to changing humidity or temperature conditions is afforded by the corrugations in the metal foi1 10 in the region of the joint so that a flexible bellows-like arrangement follows every change in position of the joint and keeps it covered and protected from climatic conditions. The soft-soldered metal foil 10 is continued into the gutter for the draining of water. Drain bores 7, as shown in FIG. 1, are lined with a thin metal pipe 11 which is corrugated in the circumferential direction and permits longitudinal expansion of the pipe. The ends 8 of the pipe are flanged over the metal foil surface in the rain trough and over the exterior surface and the flanges are soldered to the metal foil surfaces. Due to any possible movement of the wood or wood material core, the metal pipe 11 in the drain bore 7 has such a flexibility because of the corrugations that it follows every change in movement or position without breaking and maintains a seal for the underlying core 6.

Accordingly, the wood or wood material core is protected against decay due to climatic conditions affecting the exterior surfaces of the window frame on the building exterior. Therefore, the application of a protective layer on the exterior surfaces of the window frame over certain time periods is unnecessary, such as is required on uncoated wooden window frames.

The window frame surface visible or exposed on the interior of a building or house is coated with a decorative laminate 4. Similar to the metal foil laminate 2, the laminate 4 can be applied by means of a double band press under the action of heat and pressure. The construction of the decorative laminate 4 is similar to that of the metal foil laminate 2 except that the decorative film on the laminate 4 can be provided with a printed design. The design may be an imitation of a wood surface or, if desired, some other printed design. Since the inside of the window frame is exposed, not to the weather, but to the constant inside atmosphere, a metal foil is not needed to protect the interior surface from the weather. To protect the decorative film it is finished with a resin rich melamine which forms a transparent overlay film that is particularly resistant to water and is very hard. The external pressed coating of pure resin provides a seal for the interior surface of the frame and provides it with chemical stability. The surface of the metal foil laminate 2 on the exterior of the building can also be provided with embossed designs, such as imitations of wood pores or knots, flutings, and the like.

While specific embodiments of the invention have been shown and described in detail to illustrate the application of the inventive principles, it will be understood that the invention may be embodied otherwise without departing from such principles.

I claim:

1. Window frame formed in part of one of wood and wood materials, such as cemented chipboard and the like, with a pressure setting laminate coating, said window frame comprises frame sides each having an interior surface exposed to the conditions within the interior of a building and an exterior surface exposed to the weather conditions on the exterior of a building, said frame sides being joined together at mitered corner joints, each said frame side having a wood core, a metal foil laminate coated on the exterior surface of said wood core, said metal foil laminate comprising a laminated base formed of a plurality of layers of binder-impregnated thick paper heat and pressure bonded to said wood core, and a metal foil adhered to said laminated base, a molding formed of a thin metal foil extends over the mitered corner joints on the exterior corners of said frame side with said molding extending away from the mitered corner joint, said molding being soldered to said metal foil laminate at spaced locations from the mitered corner joints, said molding being corrugated in the region of the mitered corner joint and being free from said metal foil laminate adjacent said mitered corner joints, at least certain of said frame sides having drain bores therein and thin metal pipes lining said drain bores, said thin metal pipes being corrugated in the circumferential direction for affording longitudinal expansion thereof, said thin metal pipes having opposite ends flanged over and soldered to said metal foil laminate, and a decorative laminate coated on the heat and pressure bonded to the interior surface of said frame sides.

2. Window frame, as set forth in claim 1, wherein said metal foil on said metal foil laminate comprises copper.

3. Window frame, as set forth in claim 1, wherein said metal foil on said metal foil laminate comprises aluminum.

4. Window frame, as set forth in claim 1, wherein said metal foil on said metal foil laminate comprises a special steel foil.

5. Window frame, as set forth in claim 1, wherein said metal foil laminate is vapor-impermeable.

6. Window frame, as set forth in claim 1, wherein said metal foil laminate is provided with micropores so that said laminate is vapor-permeable to a desired degree.

7. Window frame, as set forth in claim 1, wherein said metal foil laminate is semipermeable.

8. Window frame, as set forth in claim 1, wherein said wood core is formed of a plurality of wood strips glued together.

9. Window frame, as set forth in claim 1, wherein the surface of said metal foil laminate is provided with the appearance of a wood surface.

10. Window frame, as set forth in claim 1, wherein the surface of said decorative laminate is provided with the appearance of a wood surface.

* * * * *